United States Patent [19]

Pawlowski et al.

[11] Patent Number: 4,482,080

[45] Date of Patent: Nov. 13, 1984

[54] CUP DISPENSER

[75] Inventors: Thomas D. Pawlowski, Neenah, Wis.; Joseph J. Vaxmonsky, Wanaque, N.J.

[73] Assignee: James River-Dixie/Northern, Inc., Norwalk, Conn.

[21] Appl. No.: 449,022

[22] Filed: Dec. 16, 1982

[51] Int. Cl.[3] ..... B65D 5/16

[52] U.S. Cl. ..... 221/310

[58] Field of Search ..... 221/303, 307, 310; 312/43; 206/217, 219, 499

[56] References Cited

U.S. PATENT DOCUMENTS 2,359,337 10/1944 Turek ..... 221/310 X 4,163,508 8/1979 Mannor ..... 221/310

*Primary Examiner*—Stanley H. Tollberg

*Attorney, Agent, or Firm*—William A. Aguele; Harry W. Hargis, III; Thomas H. Whaley

[57] ABSTRACT

A dispenser package for holding a stack of nested tapered disposable cups and dispensing them individually. The dispenser package has a generally circular opening in the top wall through which the bottoms of the tapered cups protrude; the opening is surrounded by a series of short radial slits or knife cuts defining a series of yieldable tabs around the periphery of the opening which permit the topmost protruding cup to be pulled through the opening, but which function to restrain the remaining cups in the stack. Additional slits or knife cuts in the top wall of the dispenser package extend from the opening in the top wall to each of the sidewalls at a point near each sidewall to permit loading a stack of cups through the top opening of the dispenser package without tearing of the top wall.

4 Claims, 4 Drawing Figures

CUP DISPENSER

This invention relates to a dispenser package structure for holding and dispensing a stack of nested disposable cups.

Dispensers for paper and plastic disposable cups are well known in the art. Such dispensers usually are permanently or detachably mounted on a wall or other vertical surface. It is not always practicable to mount a wall dispenser in every desired location with the result that they frequently are mounted in a location not convenient to all users.

This invention provides an improved dispenser package structure for a stack of nested paper or plastic disposable cups that is suited as portable dispenser which may be used in a variety of positions and locations with or without mounting of the dispenser package on a wall or other surface.

In a commonly assigned copending patent application of Jerome Gould, et al, Ser. No. 338,867 filed Jan. 12, 1982 now abandoned, and its continuation application, Ser. No. 550,925, filed Nov. 10, 1983, an improved disposable paperboard package structure is disclosed a which combines a cup package and dispenser, herein referred to as a dispenser package. The dispenser package comprises a boxlike container or package having substantially planar, parallel, spaced walls wherein the end walls each include a generally circular opening with the opening in the one end wall axially aligned with the opening in the other end wall. The dispenser package is adapted to hold a stack of nested paper or plastic cups of conventional shape, each cup having a tapered side wall, a circular bottom wall, and a circular open top, the bottom wall of a cup being smaller in diameter than its top and smaller than the dispensing opening in the package, hereinafter referred to as the top wall. The open end of the cup is of larger diameter than the opening in the top wall of the container so that when the container is loaded with a stack of cups, the cups protrude through the opening in the top wall of the container and rest on the other end wall, hereinafter referred to as the bottom wall. It will be understood that the dispenser may be used in any position and that the terms top wall and bottom wall are used herein for convenience of description and not by way of limitation. Cups may be removed or dispensed one at a time from the dispenser package by grasping a cup protruding through the opening in the top wall of the dispenser package and pulling it through the opening. A plurality of flexible tabs or fingers surround the top opening of the dispenser package which permit a cup to be withdrawn from the package while retaining the other cups in the stack within the dispenser package.

It has now been found that the dispenser package of said commonly assigned copending application is subject to damage due to tearing of the top of the package during loading of a stack of cups into the package. Such damage may result in loss of the ability of the dispenser package to restrain the remaining cups comprising the stack in the container when the outermost cup is removed. The subject invention is directed to a modification of the top of the dispenser package which permits a stack of cups to be loaded into the package through the top opening without tearing of the top of the disposable paperboard dispenser package. As a result of the improved dispenser package structure, a stack of cups may be loaded into the dispenser package through the top opening thereof without danger of impairing the ability of the dispenser package to dispense cups one at a time.

The present invention and its relationship to the invention disclosed in our copending patent application will be more fully understood from the following detailed description and the accompanying drawings, wherein FIG. 1 is a perspective view of a dispenser package of nested cups embodying this invention;

Figure 1:
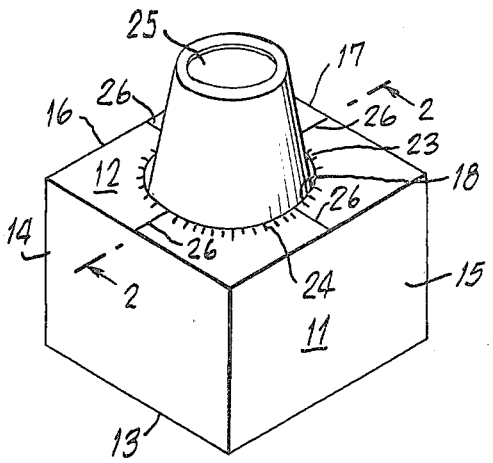

With reference to FIG. 1 of the drawings, a dispenser package 11 is illustrated. The dispenser package 11 as illustrated is of generally cubical configuration, including planar, parallel, spaced top and bottom walls 12 and 13, respectively, joined by planar side walls 14, 15, 16 and 17. Although illustrated as a foreshortened cube, the dispenser package may be of any desired length. A cube or a relatively short container having the top wall spaced from the bottom wall by less than the height of one cup is preferred and is particularly convenient to use as it may be used in any position. A particularly convenient position is illustrated in FIGS. 1 and 2 with the cups in the stack bottom up the container resting on a flat surface.

Figure 3:
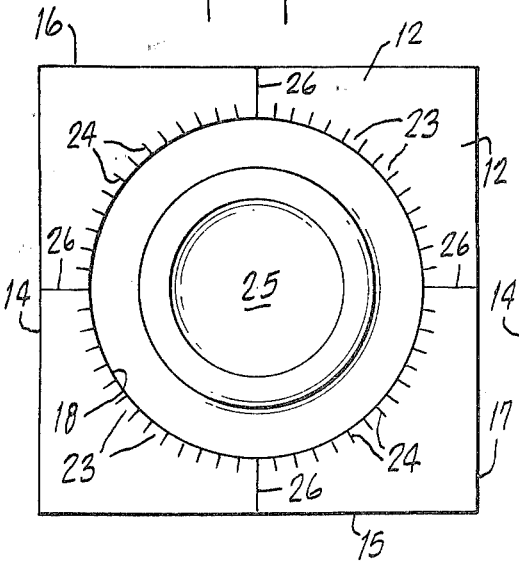
FIG. 3 is a plan view of the package illustrated in FIG. 1.
Figure 4:
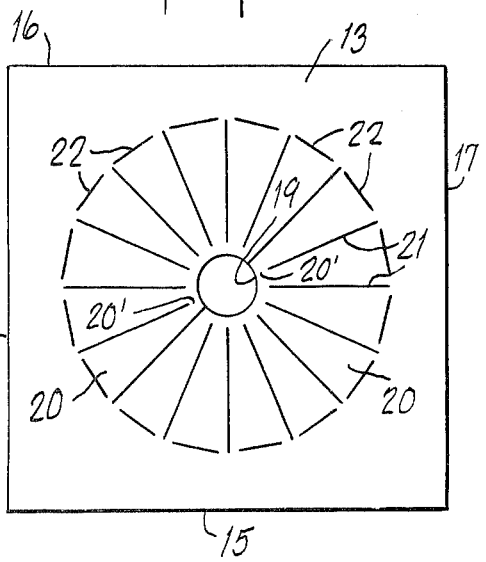
FIG. 4 is a bottom view of the package illustrated in FIG. 1.

As illustrated in FIG. 3, the top wall 12 of the dispenser package is provided with a generally circular opening 18. In a preferred embodiment as illustrated in FIG. 4, the bottom wall 13 includes a central opening 19 axially aligned with opening 18 and a generally circular line of perforations 22 outlining a polygon. The polygon outlined by perforations 22 preferably is of smaller or lesser diameter than opening 18 in the top wall 12 of the container. A plurality of uniformly sized tabs 20 is defined by radial slits or knife cuts 21 in bottom wall 13 of the dispenser package extend from the outer circumference of the polygon 22 to an area adjacent opening 19 terminating along the periphery of polygon 22, the perforations outlining polygon 22 extending transversely of the bases of the tabs 22. Perforations 22 are arranged so that they do not intersect slits 21, i.e. the perforations 22 do not join slits 21. Tabs 20 may be pushed inward to form an opening in the bottom 14 of the dispenser package, preferably of somewhat smaller diameter than opening 18 in the top of the package, the tabs 23 bending along lines defined by perforations 22.

Opening 18 in the top of the dispenser package is substantially defined by tabs 23 which, in turn, are defined by relatively short radial knife cuts 24, the purpose of which will become apparent from the following description of their function.

Figure 2:
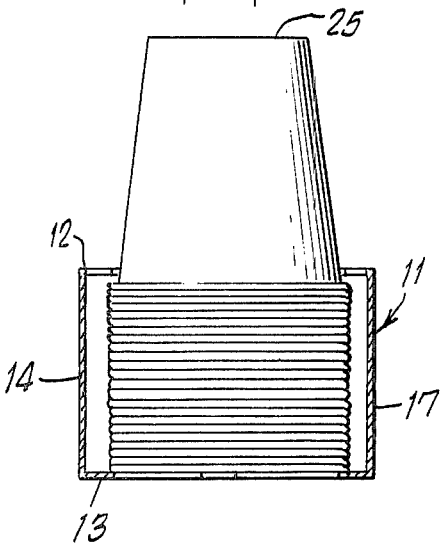
FIG. 2 is an elevational view partly in cross section showing of the dispenser package illustrated in FIG. 1, sectioned along the line 2—2.

In use, a stack of tapered cups 25 is disposed in dispenser package 11 as illustrated in FIG. 2, such that the tapered side wall and bottom wall of the end cup of a cup stack protrudes through opening 18, and the open top of the other end cup of the same cup stack rests on the bottom wall 13, in the region of perforations 22. Tabs 23 defining opening 18 are sufficiently flexible and resilient, as is the nature of the paperboard, to accommodate one-at-a-time removal of cups through opening 18.

The tabs 20 in the bottom of package 12 permit stacking of loaded dispenser packages. In stacking, the packages 11 are so positioned that the protruding end of cup 25 of a cup stack in one package 11, i.e. a lower package, extends through the opening in the bottom wall 13 of another dispenser package, i.e. an upper package, the radial tabs 20 bending inwardly along perforations 22 into in the open top of the last cup of the stack in the upper package. When the dispenser packages are stacked, the bottom wall 13 of the upper package is in contact with the top wall 12 of the lower package, whereby the upper package is supported on the lower one. A pair of stacked packages may be separated simply by lifting off the upper package.

In accordance with the present invention, the top wall 12 of the dispenser package 11 is provided with slits or knife cuts 26 extending from the circular opening 18 to each of the sidewalls 14, 15, 16, and 17, at a point on the circular opening 18 adjacent each sidewall. The slits or knife cuts 26 are preferably positioned to extend from the center of the top of each side wall to the circular opening 18, the cuts intersecting the circular opening at a point on its periphery nearest the adjacent sidewall. It has been found that provision of the slits or knife cuts 26 permit a stack of cups 25 to be loaded into the package 11 through the top opening 18 without tearing the top wall 12 and without disabling the tabs 23.

In the preferred embodiment of this invention, tabs 20 formed by knife cuts 21 on the bottom wall 13 of the dispenser package are joined at their inner ends by webs 20' holding the tabs 20 in place until the webs are ruptured by insertion of the small end of a protruding stack 25 of cups in one package into the open end of a stack 25 of cups in another package thereby tearing the webs 20' and pushing tabs 20 inward. It will be evident that any number of dispenser containers may be stacked in this manner to form a compact package.

While paperboard is the preferred material of the carton, it will be apparent that other materials affording adequate flexibility and resilience for flexure of the tabs, such as polyethylene or like plastic, or laminates including paperboard, plastic, or metal foil, will be suitable for use in achieving objectives and advantages of the invention.

We claim:

1. In a dispenser package structure for packaging and separately dispensing from a stack rimmed tapered disposable cups each of which has a tapered sidewall, a bottom, and an open top surrounded by a rolled rim comprising a container having substantially square planar, parallel, mutually spaced top and bottom walls; and connecting rectangular side walls, a circular opening in the top wall of a size sufficient to permit the bottom and tapered side wall of a cup to extend freely therethrough and insufficient to permit passage of the rim of a cup therethrough, and a plurality of relatively short radial slits or knife cuts surrounding said opening in said top wall defining a plurality of flexible tabs lying in the plane of said top wall and capable of being deflected in the direction of movement of a cup through said opening to permit passage of a cup therethrough by flexure of said tabs, the improvement comprising an elongated radial slit extending from the edge of said opening in said top to the mid point of each of said sidewalls, said elongated radial slits extending beyond all of the intervening radial slits defining the tabs surrounding the opening.

2. A dispenser package as defined in claim 1 wherein said bottom wall includes an opening smaller in diameter than the opening in said top wall and axially aligned therewith, a plurality of radial slits extending from a point adjacent said opening in said bottom wall outwardly to provide at least one arcuate web between said opening and the inner ends of said slits, said slits extending outwardly from said web a distance sufficient to exceed the radius of the small end of a cup but less than a distance equal to the radius of the large end of a cup whereby the bottom wall is held substantially intact until the small end of a cup is inserted into said container through said bottom wall breaking said webs and permitting said tabs to fold inwardly thereby permitting stacking of loaded dispenser packages.

3. A dispenser package as defined in claim 2 wherein a majority of said slits in said bottom wall terminate at their inner ends adjacent said opening in said bottom wall defining at least one uncut arcuate web between said opening and said slits and holding said tabs in fixed position relative to one another until said web is ruptured.

4. A dispenser package as defined in claim 2 wherein a plurality of knife cuts in a generally circular pattern is provided in said bottom wall at the outer ends of said radial slits defining said tabs in a non-intersecting relationship with said tabs and forming a generally circular line of weakness facititating bending of said tabs inwardly along fold lines defined by said pattern of knife cuts.

* * * * *